US012543802B1

(12) United States Patent
Edward

(10) Patent No.: US 12,543,802 B1
(45) Date of Patent: Feb. 10, 2026

(54) INFANT SWADDLING GARMENT ASSEMBLY

(71) Applicant: Ogechukwu Edward, St. Louis Park, MN (US)

(72) Inventor: Ogechukwu Edward, St. Louis Park, MN (US)

( * ) Notice: Subject to any disclaimer, the term of this patent is extended or adjusted under 35 U.S.C. 154(b) by 0 days.

(21) Appl. No.: 18/509,552

(22) Filed: Nov. 15, 2023

(51) Int. Cl.
*A41B 13/06* (2006.01)

(52) U.S. Cl.
CPC ..... *A41B 13/06* (2013.01)

(58) Field of Classification Search
CPC ..... A41B 13/06; A41B 13/005; A41B 13/008; A41B 2400/80; A41B 2400/82; A41B 13/065; A41D 13/1272; A41F 1/002
See application file for complete search history.

(56) References Cited

U.S. PATENT DOCUMENTS

| | | | | |
|---|---|---|---|---|
| 6,817,032 | B2 * | 11/2004 | Hollander | A61F 5/3723 2/69 |
| 9,872,523 | B2 | 1/2018 | Salkovic | |
| 2016/0021936 | A1 | 1/2016 | Delano | |
| 2017/0035129 | A1 * | 2/2017 | Srivastava | A41B 1/10 |
| 2018/0332902 | A1 | 11/2018 | Damir | |
| 2022/0007767 | A1 * | 1/2022 | Harris | A41F 1/002 |

* cited by examiner

*Primary Examiner* — Sally Haden

(57) ABSTRACT

An infant swaddling garment assembly for selectively positioning the arms of an infant in a releasably secured condition against the torso of the infant includes an infant garment, which comprises a torso section to which is attached a plurality of sleeves that includes a left arm sleeve and a right arm sleeve. The torso section and the left and right arm sleeves receive a torso and arms of an infant, respectively. The torso section has an upper edge, which is open and which defines a neck opening. A connection assembly releasably attaches the left and right arm sleeves at respective selectable positions on a front side of the torso section. The connection assembly thus enables selectively positioning of the arms of the infant in a releasably secured condition against the torso of the infant.

7 Claims, 6 Drawing Sheets

INFANT SWADDLING GARMENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to swaddling garments and more particularly pertains to a new swaddling garment for selectively positioning the arms of an infant in a releasably secured condition against the torso of the infant.

(2) Description of Related Art Including Information Disclosed Under 37 CFR 1.97 and 1.98

The prior art relates to swaddling garments but which do not allow the arms of an infant to be releasably secured against the torso of the infant at user selected positions. The prior art does not include a connection assembly allowing an infant to adjust their arms relative to their torso while maintaining the arms in a secured condition.

BRIEF SUMMARY OF THE INVENTION

An embodiment of the disclosure meets the needs presented above by generally comprising an infant garment, which comprises a torso section to which is attached a plurality of sleeves that includes a left arm sleeve and a right arm sleeve. The torso section and the left and right arm sleeves are configured to receive a torso and arms of an infant, respectively. The torso section has an upper edge, which is open and which defines a neck opening. A connection assembly releasably attaches the left and right arm sleeves at respective selectable positions on a front side of the torso section. The connection assembly thus is configured to selectively position the arms of the infant in a releasably secured condition against the torso of the infant.

Another embodiment of the disclosure includes a method of swaddling an infant, which entails provision of an infant swaddling garment assembly, according to the disclosure above. Steps of the method include positioning a torso and arms of an infant into the infant garment, releasably attaching a first mating member that is attached to the terminal end of the left arm sleeve to a second mating member that is attached the left portion of the front side of the torso section, and releasably attaching a first mating member that is attached to the terminal end of the right arm sleeve to a second mating member that is attached the right portion of the front side of the torso section.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
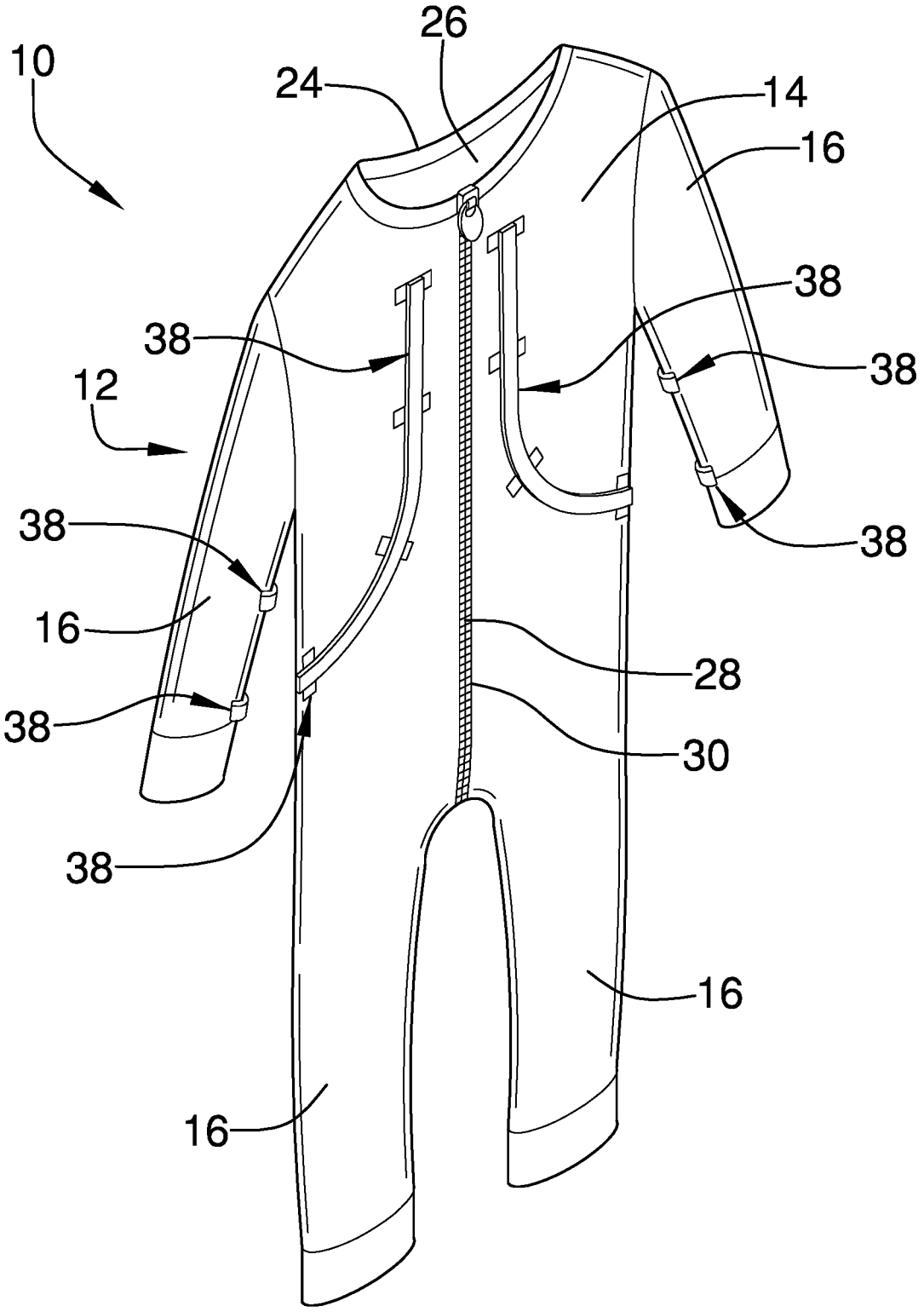
FIG. 1 is an isometric perspective view of an infant swaddling garment assembly according to an embodiment of the disclosure.

With reference now to the drawings, and in particular to FIGS. 1 through 6 thereof, a new swaddling garment embodying the principles and concepts of an embodiment of the disclosure and generally designated by the reference numeral 10 will be described.

As best illustrated in FIGS. 1 through 6, the infant swaddling garment assembly 10 generally comprises an infant garment 12 having a torso section 14 to which is attached a plurality of sleeves 16. The plurality of sleeves 16 typically includes a left arm sleeve 18, a right arm sleeve 20, and a pair of leg sleeves 22. The torso section 14, the left 18 and right 20 arm sleeves, and the pair of leg sleeves 22 are configured to receive a torso, arms, and legs of an infant, respectively. As is shown in the figures, the left 18 and right 20 arm sleeves may open so that hands of the infant protrude from the left 18 and right 20 arm sleeves, respectively. The present invention also anticipates the left 18 and right 20 arm sleeves each being closed with a mitten, or the like. Also as is shown in the figures, the leg sleeves 22 may be open, although the present invention also anticipates each leg sleeve 22 being terminated by a bootie, or the like.

The torso section 14 has an upper edge 24, which is open and which thus defines a neck opening 26. The torso section 14 has a slit 28 positioned therein, with the slit 28 extending from the neck opening 26 downwardly into the torso section 14. A closure 30 is attached to the torso section 14 to releasably close the slit 28. As is shown in FIG. 1, the slit 28 is positioned in a front side 32 of the torso section 14, although the present invention also anticipates the slit 28 being positioned in a back side 34 of the torso section 14. Such garments for infants typically include slits to facilitate donning of an infant with the garment. The closure 30 may comprise a zipper 36, as is shown in the figures, or other closing means, such as, but not limited to, buttons, snaps, ties, hook and loop fasteners, or the like.

A connection assembly 38 releasably attaches the left 18 and right 20 arm sleeves at respective selectable positions on the front side 32 of the torso section 14. The connection assembly 38 thus is configured to selectively position the arms of the infant in a releasably secured condition against the torso of the infant.

Figure 2:
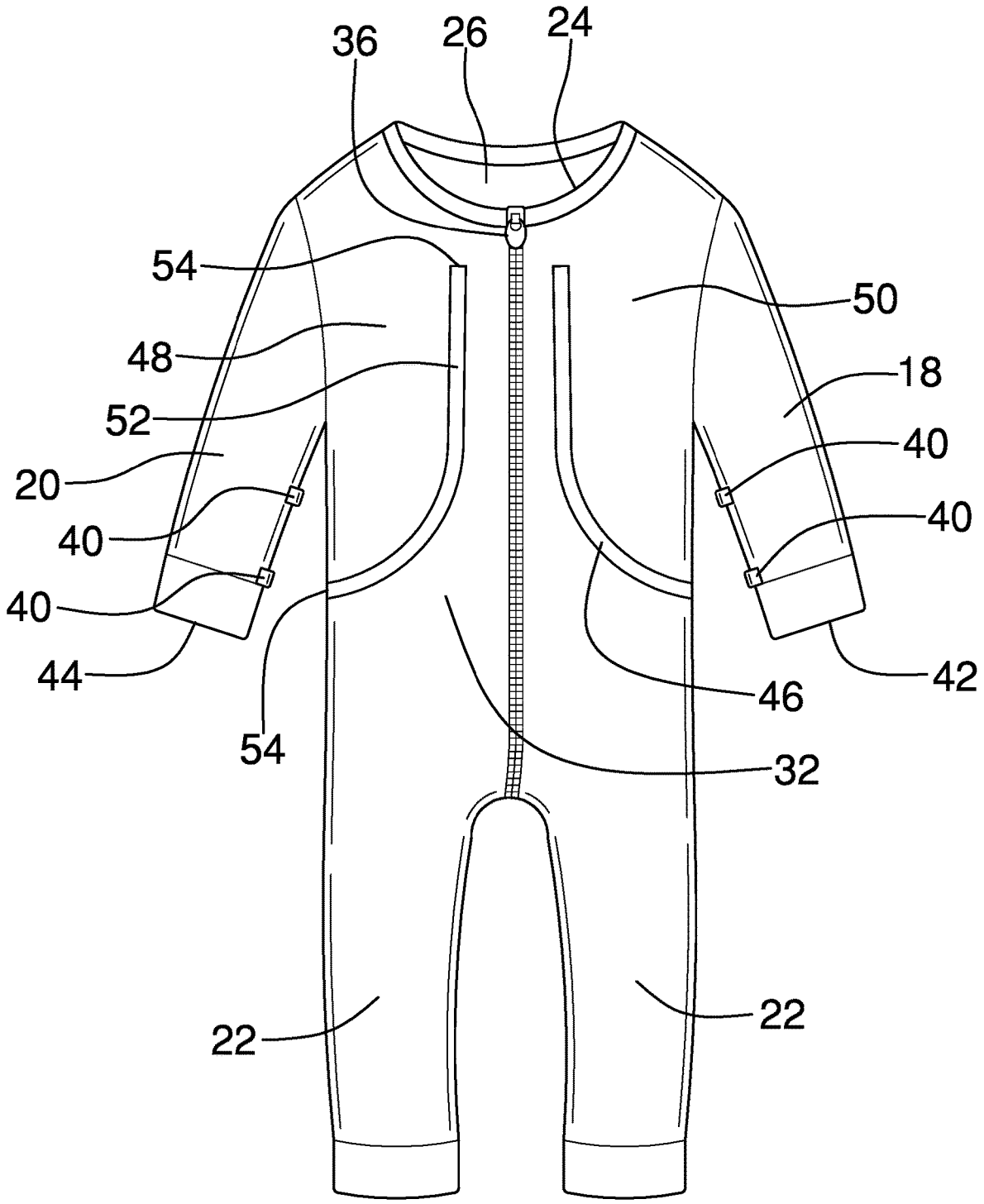
FIG. 2 is a front view of an embodiment of the disclosure.

The connection assembly 38 comprises a pair of first mating members 40, the first mating members 40 of which are attached singly to terminal ends (42 and 44, respectively) of the left 18 and right 20 arm sleeves, and a pair of second mating members 46, the second mating members 46 of which are attached singly to a right portion 48 and a left portion 50 of the front side 32 of the torso section 14. As is shown in FIG. 2, each second mating member 46 is formed as an elongate strip 52 having opposed ends 54. Thus, each first mating member 40 is releasably attachable to a respective elongate strip 52 at a respective position between the opposed ends 54. As shown in FIG. 2, the first mating members 40 may also be positioned at the elbows as well to add additional connection points between the arm sleeves 18, 20 and the front side 32 of the torso section 14.

The elongate strips 52 may be magnetically attracted to the first mating members 40 so that each first mating member 40 is releasably attachable to and slidable along a respective elongate strip 52. The connection assembly 38 is configured to restrict a range of motion of the arms of the infant relative to the torso of the infant. The present invention also anticipates the first mating member 40 and the elongate strip 52 comprising hook and loop fastener, a snap closure, or the like, so that the arms of the infant are selectively positionable in a releasably secured condition against the torso of the infant at selectable positions between the opposed ends 54 of the elongate strips 52.

In one embodiment, the first mating members 40 are magnetic and the elongate strips 52 are paramagnetic. In another embodiment, the first mating members 40 are paramagnetic and the elongate strips 52 are magnetic. In yet another embodiment, the first mating members 40 and the elongate strips 52 are magnetic and the first mating members 40 are pole matched to the elongate strips 52. Such magnetic mating members are well known to those skilled in the art of magnets and include flexible strips that can be attached to the infant garment 12 by conventional means. In addition to the well documented benefits of swaddling, the infant swaddling garment assembly 10 is anticipated to be useful in monitoring preferred positioning of hands of infants and providing recommendations to parents to optimize the effectiveness of swaddling their infants.

Each elongate strip 52 may comprise a linear section 56 and an arcuate section 58, as is shown in FIG. 2. The linear section 56 has an upper end 60 that is positioned proximate to the upper edge 24 and extends downwardly to a lower end 62. The linear sections 56 of the elongate strips 52 are positioned so as to bracket a centerline 64 of the front side 32. The arcuate section 58 is attached to the lower end 62 of the linear section 56 and extends downwardly from the linear section 56 and away from the centerline 64. This shape of the elongate strips 52 positions the elongate strips 52 along the torso to cover a range of positions for releasably attaching the first mating members 40.

Figure 3:
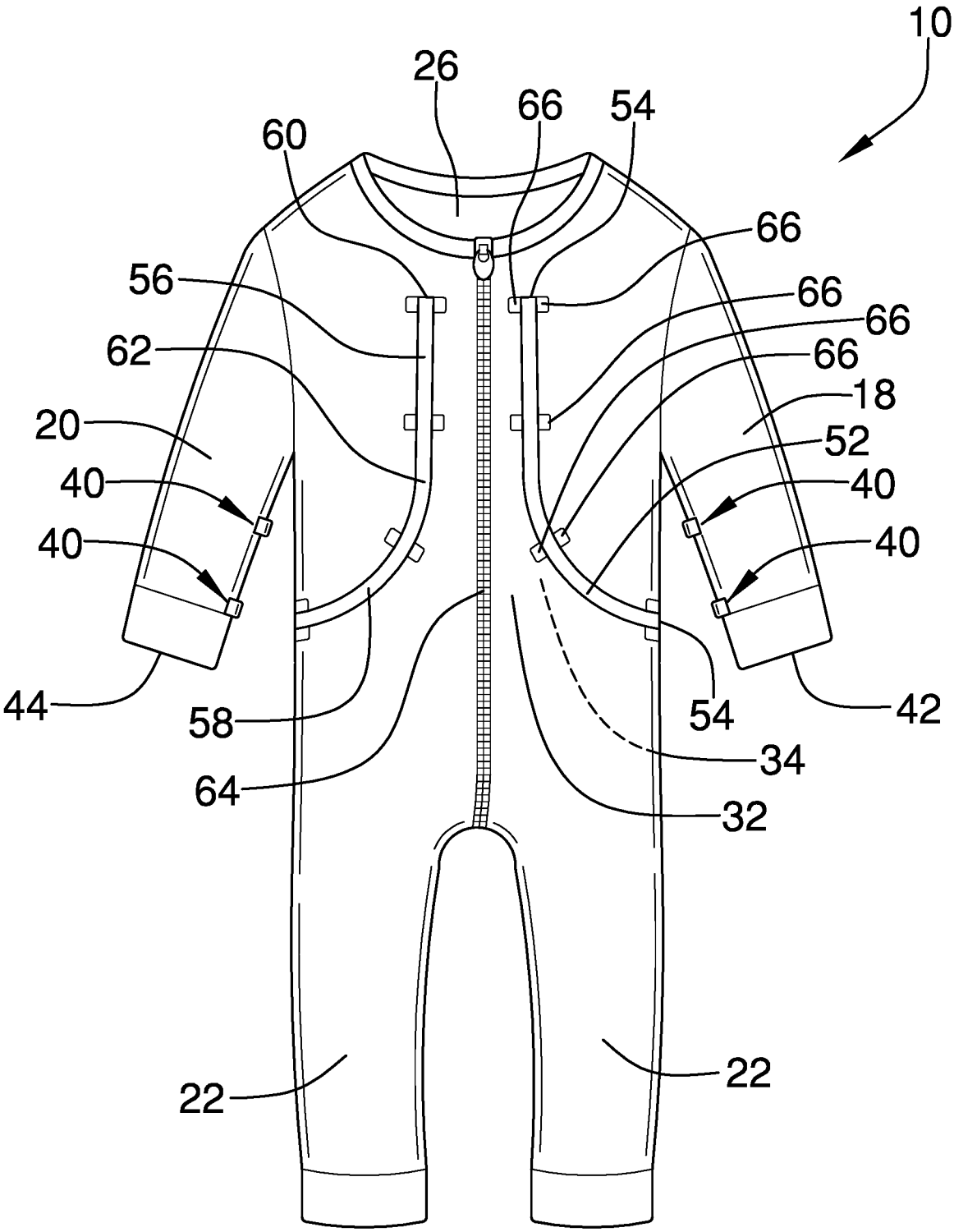
FIG. 3 is a front view of an embodiment of the disclosure.
Figure 4:
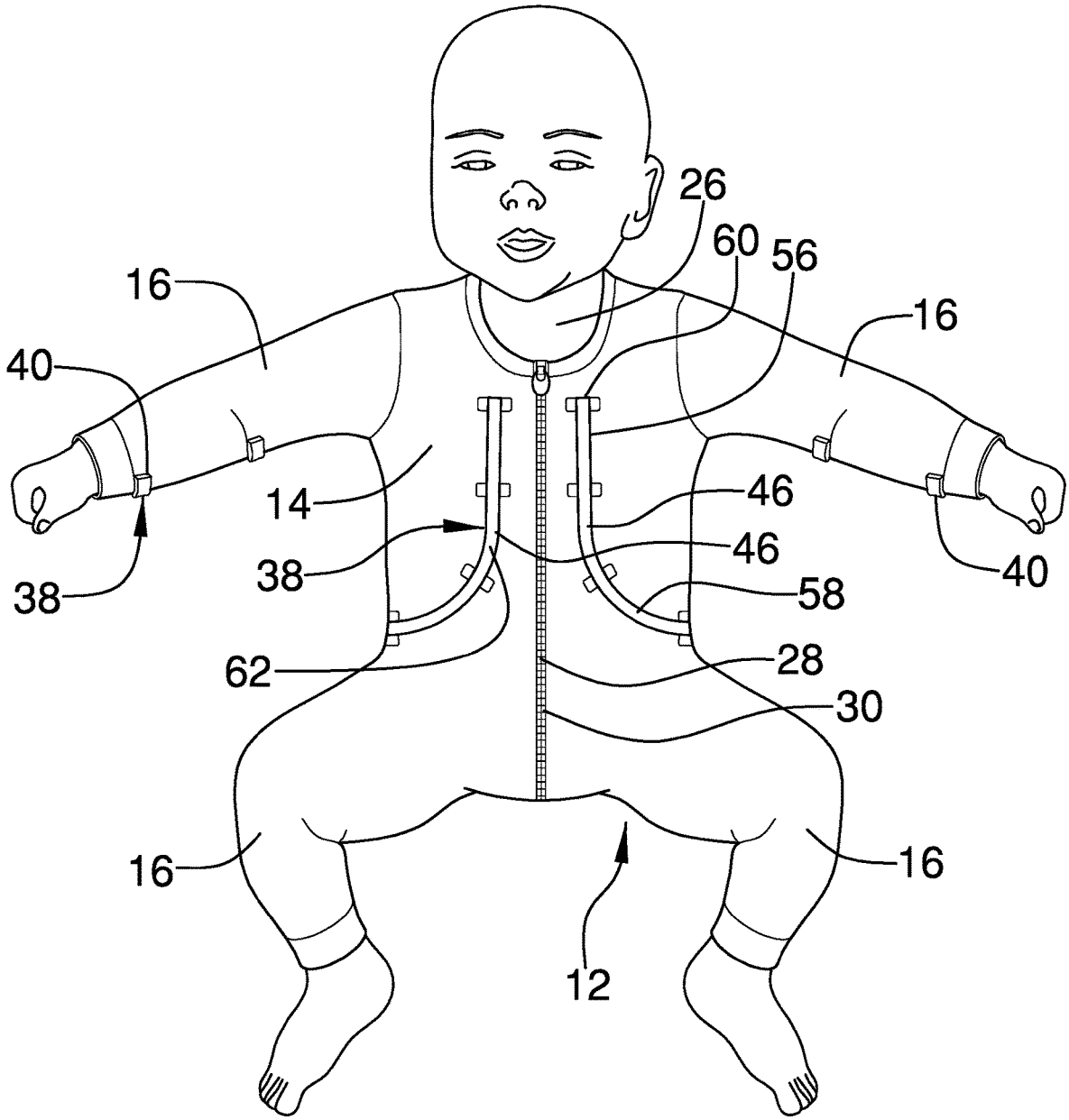
FIG. 4 is an in-use view of an embodiment of the disclosure.
Figure 5:
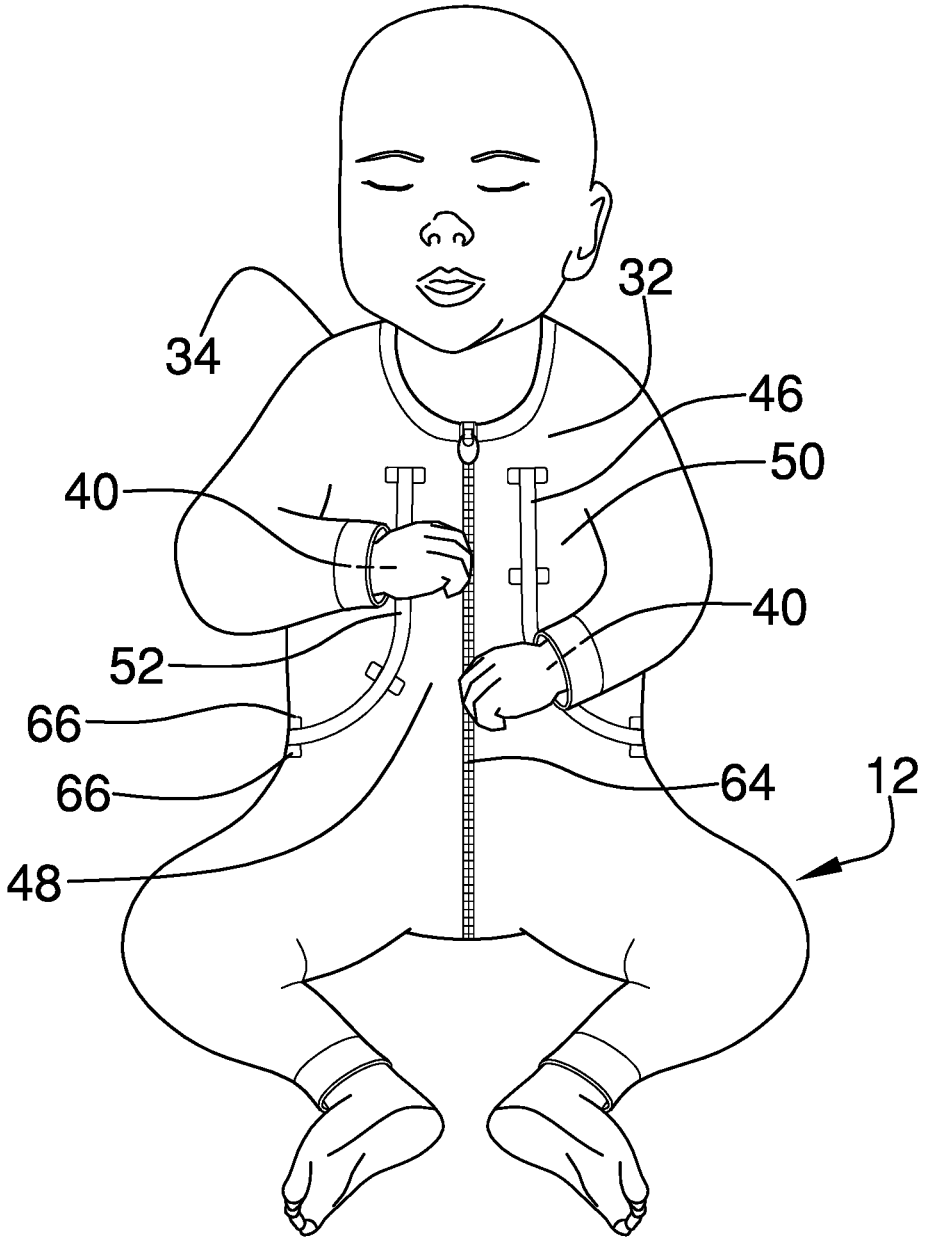
FIG. 5 is an in-use view of an embodiment of the disclosure.
Figure 6:
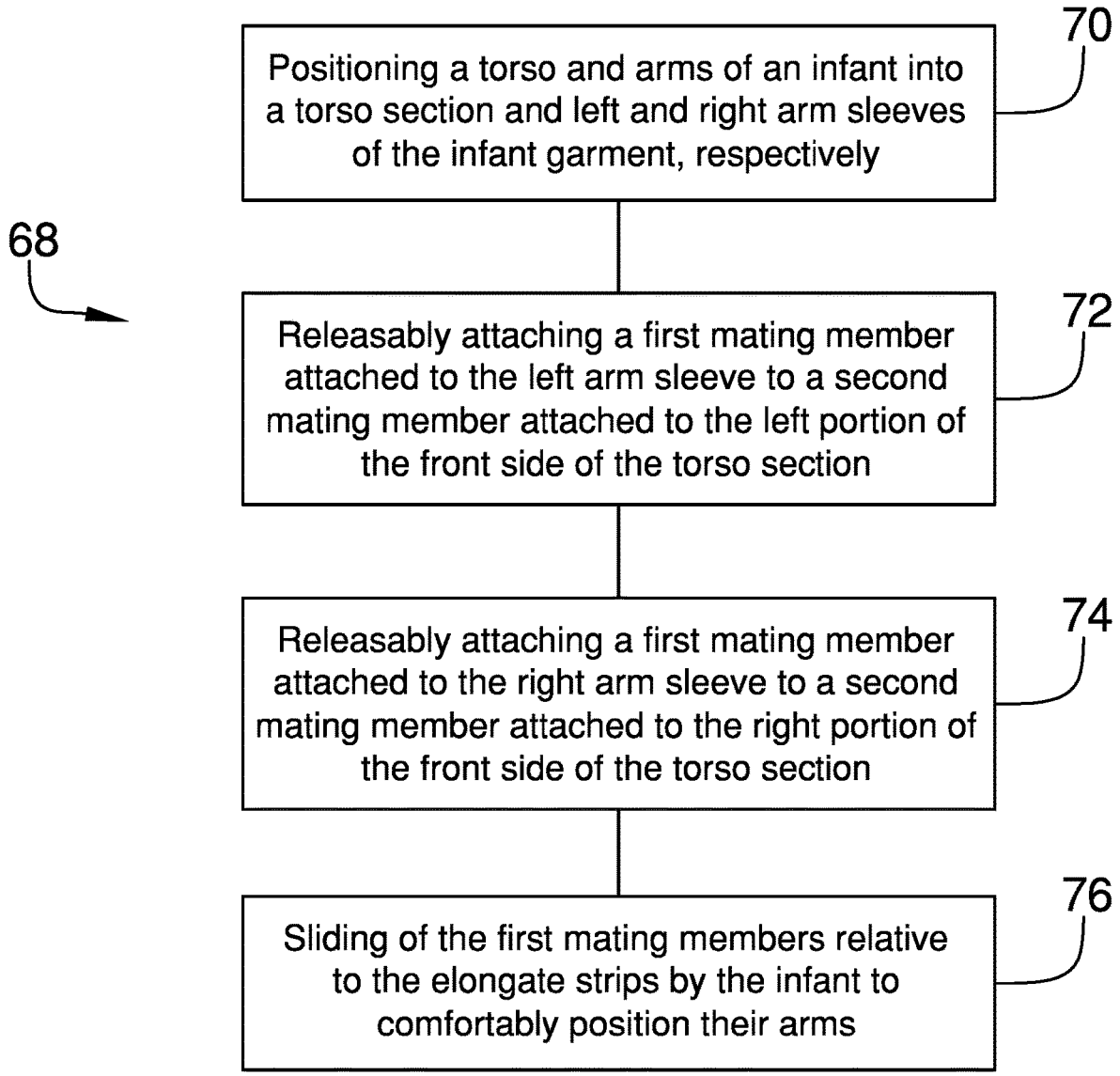
FIG. 6 is a flow diagram for a method utilizing an embodiment of the disclosure.

Each second mating member 46 may be formed as the elongate strip 52 along with a set of blocks 66, as is shown in FIG. 3. The blocks 66 are spaced along the elongate strip 52 between the opposed ends 54 so that each first mating member 40 is releasably attachable to one or more blocks 66 to selectively position the arms of the infant in a releasably secured condition against the torso of the infant. Also as shown in FIG. 3, the blocks 66 may be positioned so as to bracket the elongate strip 52. "Blocks" is used herein descriptively and is not intended to be limited to cuboid shapes. The present invention also anticipates the blocks 66 being disc shaped, triangular prismatic shaped, or the like. As can be seen in FIG. 1, the elongated strip 52 may be raised compared to the blocks 66. This will allow connection between first mating members 40 on the sleeves to the blocks 66 at points which do not allow the movement of the first mating member relative to the garment 12.

In use, the infant swaddling garment assembly 10 enables a method of swaddling an infant 68. The method 68 comprises providing the infant swaddling garment assembly 10, according to the specification above. A first step 70 of the method 68 is positioning a torso and arms of an infant into a torso section 14 and a left arm sleeve 18 and a right arm sleeve 20 of the infant garment 12, respectively. A second step 72 of the method 68 is releasably attaching a first mating member 40 that is attached to the terminal end 42 of the left arm sleeve 18 to a second mating member 46 that is attached the left portion 50 of the front side 32 of the torso section 14 to selectively position a left arm of the infant in a releasably secured condition against the torso of the infant. A third step 74 of the method 68 is releasably attaching a first mating member 40 that is attached to the terminal end 44 of the right arm sleeve 20 to a second mating member 46 that is attached the right portion 48 of the front side 32 of the torso section 14 to selectively position a right arm of the infant in a releasably secured condition against the torso of the infant.

In some embodiments, the assembly 10 may include data collection means. In particular, the first 40 and second 46 mating members may include electronic contacts coupled to a processor and memory for collecting data on where an infant prefers to retain their arms while being in a swaddled position. This will allow for future improvements in design of the assembly 10 as well as be able to monitor movements of a child throughout their sleep cycle. The data would not include where the locations of the connections were being made, but also the duration of each contact.

The method 68 above is not intended to limit use of the infant swaddling garment assembly in any manner. For example, a first mating member 40 attached to the terminal end 42 of the left arm sleeve 18 could be attached to a second mating member 46 attached the right portion 48 of the front side 32 of the torso section 14 and a first mating member 40 attached to the terminal end 44 of the right arm sleeve 20 could be attached to a second mating member 46 attached the left portion 50 of the front side 32 of the torso section 14 to effectively cross the arms of the infant.

With each second mating member 46 being formed as an elongate strip 52 and being magnetically attracted to the first mating members 40, each first mating member 40 is releasably attachable to and slidable along a respective elongate strip 52. The method 68 in this case includes a fourth step 76 of sliding of the first mating members 40 relative to the elongate strips 52 by the infant to comfortably position their arms.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An infant swaddling garment assembly comprising:

an infant garment comprising a torso section having a plurality of sleeves attached thereto and being configured to receive a torso and arms of an infant, respectively, the plurality of sleeves including a left arm sleeve and a right arm sleeve, the torso section having an upper edge being open and defining a neck opening;

a connection assembly releasably attaching the left arm sleeve and the right arm sleeve at respective selectable positions on a front side of the torso section, wherein the connection assembly is configured to selectively position the arms of the infant in a releasably secured condition against the torso of the infant;

wherein the connection assembly comprises:

a pair of first mating members being attached singly to terminal ends of the left arm sleeve and the right arm sleeve; and a pair of second mating members being attached singly to a right portion and a left portion of the front side of the torso section, each second mating member being formed as an elongate strip having opposed ends such that each first mating member is releasably attachable to a respective second mating member at a selectable position between the opposed ends;

wherein each elongate strip comprises a linear section having an upper end positioned proximate to the upper edge and extending downwardly to a lower end, such that the linear sections of the pair of second mating members bracket and are parallel to a centerline of the front side; and an arcuate section attached to the lower end of the linear section and extending downwardly from the linear section and away from the centerline such that the elongate strip extends towards a back of the infant garment; and wherein one of the first or second mating members is magnetic and the other of the first or second mating members is magnetic or paramagnetic such that each first mating member is releasably attachable to and slidable along a respective elongate strip while maintaining connection between the first mating member and the second mating member, wherein the connection assembly is configured to permit sliding but restrict a range of motion of the arms of the infant relative to the torso of the infant.

2. The infant swaddling garment assembly of claim 1, wherein the first mating members are magnetic and the elongate strips are paramagnetic.

3. The infant swaddling garment assembly of claim 1, wherein the first mating members are paramagnetic and the elongate strips are magnetic.

4. The infant swaddling garment assembly of claim 1, wherein the first mating members and the elongate strips are magnetic and the first mating members are complementary in polarity to the elongate strips wherein the first mating members are engageable to the elongate strips.

5. The infant swaddling garment assembly of claim 1, further including each second mating member being formed as the elongate strip and a set of blocks, each of the blocks being spaced along the elongate strip between the opposed ends, such that each first mating member is releasably attachable to one or more blocks of the set of blocks to selectively position the arms of the infant in a releasably secured condition against the torso of the infant.

6. The infant swaddling garment assembly of claim 1, further including:

the torso section having a slit positioned therein and extending from the neck opening downwardly into the torso section; and a closure being attached to the torso section to releasably close the slit.

7. The infant swaddling garment assembly of claim 1, further including the plurality of sleeves comprising a pair of leg sleeves configured to receive legs of the infant.

* * * * *